United States Patent [19]

Hardy

[11] 4,008,554

[45] Feb. 22, 1977

[54] PACKAGING MACHINES AND METHODS OF PACKAGING ARTICLES

[75] Inventor: Peter D. Hardy, Welwyn Garden City, England

[73] Assignee: The Metal Box Limited, Reading, England

[22] Filed: Oct. 7, 1975

[21] Appl. No.: 620,268

[30] Foreign Application Priority Data

Oct. 12, 1974 United Kingdom ..... 44298/74

[52] U.S. Cl. ..... 53/30 R; 53/22 A; 53/112 A; 53/184 R

[51] Int. Cl.[2] ..... B65B 47/10

[58] Field of Search ..... 53/22 A, 30 R, 112 A, 53/184 R

[56] References Cited

UNITED STATES PATENTS 3,805,486 4/1974 Mahaffy et al. ..... 53/22 A

FOREIGN PATENTS OR APPLICATIONS 1,232,955 5/1971 United Kingdom

*Primary Examiner*—Robert Louis Spruill
*Attorney, Agent, or Firm*—Diller, Brown, Ramik & Wight

[57] ABSTRACT

A packing machine is described having rollers respectively guiding first and second webs of flexible packing material along a horizontal path, and a conveyor for feeding a succession of articles onto the first web to be conveyed by the first web along the horizontal path. Two blocks are provided for forming a cavity around each article and through which the two webs pass. A pressure difference is provided to inelastically expand the two webs to conform to opposite halves of the cavity in which the article is housed and so form pockets therein. Two heat sealing blocks are located downstream of blocks to seal the perimeter of the pocket in the first web to the perimeter of the adjacent pocket in the second web.

13 Claims, 2 Drawing Figures

PACKAGING MACHINES AND METHODS OF PACKAGING ARTICLES

BACKGROUND OF THE INVENTION

1. Field of the Invention

The present invention relates to packaging machines and to methods of packaging articles.

2. Description of the prior art

A previously proposed method of producing packs involved the steps of locating the intended contents of the packs in succession on a generally horizontally supported sheet of stretchable packaging material, clamping the sheet peripherally of each region of the sheet material which supports the intended contents, applying differential pressure to the region to stretch the sheet in the downward direction to accommodate the contents, and closing the pocket with a further sheet of material superimposed upon the first-mentioned sheet material and bonded thereto peripherally of the side region to form a said pack.

In the above method, the sheet is elastically stretched so that when released after being sealed, it contracts around the contents to produce a substantially flat pack. This method has the disadvantage that the elastic stretching of the sheet produces stresses in the parts of the sheet which are to be sealed so that during or immediately after sealing, these tensions tend to relieve themselves by crinkling the sheet and so there is a great danger of an imperfect seal being formed or the seal rupturing.

SUMMARY OF THE INVENTION

According to the invention there is provided a method of producing packs, comprising the steps of locating the intended contents of the packs in succession on a generally horizontally supported sheet of inelastically stretchable packaging material, clamping the sheet peripherally of each region of the sheet material which supports the intended contents, applying differential pressure to the region to inelastically stretch the sheet in the downward direction to form an upwardly open pocket holding the said contents, and closing the pocket with a further sheet of material superimposed upon the first-mentioned sheet material and bonded thereto peripherally of the said region to form a said pack.

According to the invention there is further provided a packaging machine for forming packs, comprising first transport means arranged for feeding a first web of a plastics or cellulosic material along a generally horizontal path from an inlet to an outlet, means for feeding the intended contents of said packs to said inlet to be received on successive regions of the upper surface of the web for transport along said path in longitudinally spaced relation, web forming means operative upon the first web at the said successive regions to clamp the web peripherally of the regions and while clamped to stretch the web inelastically in the downward direction by differential pressure and thereby form upwardly open pockets for receiving the intended contents therein, second transport means arranged for superimposing on the first web, after the stretching thereof, a second web of material which is sealable to the sheet material of the first web whereby to close the pockets and thereby form enclosures housing the said contents and sealing means effective upon the superposed webs to seal the webs together peripherally of the enclosures whereby to form a series of linked packs for later severance from one another to form said packs.

According to the invention there is still further provided a packing machine comprising means for guiding a first web of flexible packing material along a horizontal path, means for feeding a succession of articles onto the first web to be conveyed by the first web along the horizontal path, means for forming a cavity at least partially around each article and through which the first web passes, pressure difference means for inelastically expanding the first web to conform to the cavity in which the article is at least partially housed and so form a pocket therein, means for guiding a second web to cover the pockets in the first web, and means for sealing the perimeter of the first web around the said pocket to the adjacent portion of the second web.

BRIEF DESCRIPTION OF THE DRAWINGS

Bacon rasher packaging machines embodying the invention will now be described, by way of example, with reference to the accompanying diagrammatic drawings in which.

DESCRIPTION OF THE PREFERRED EMBODIMENTS

The machine to be described is arranged to receive batches 4 of shingled bacon rashers and to pack and vacuum seal each batch in an envelope of a suitable stretchable and preferably transparent plastics or cellulosic film.

The machine includes an endless belt conveyor 2 arranged to feed the batches 4 at regular intervals into an inlet 6 of the packaging machine. When packaged the batches 4 are discharged through an outlet 8 of the machine for later severance from one another.

Figure 1:
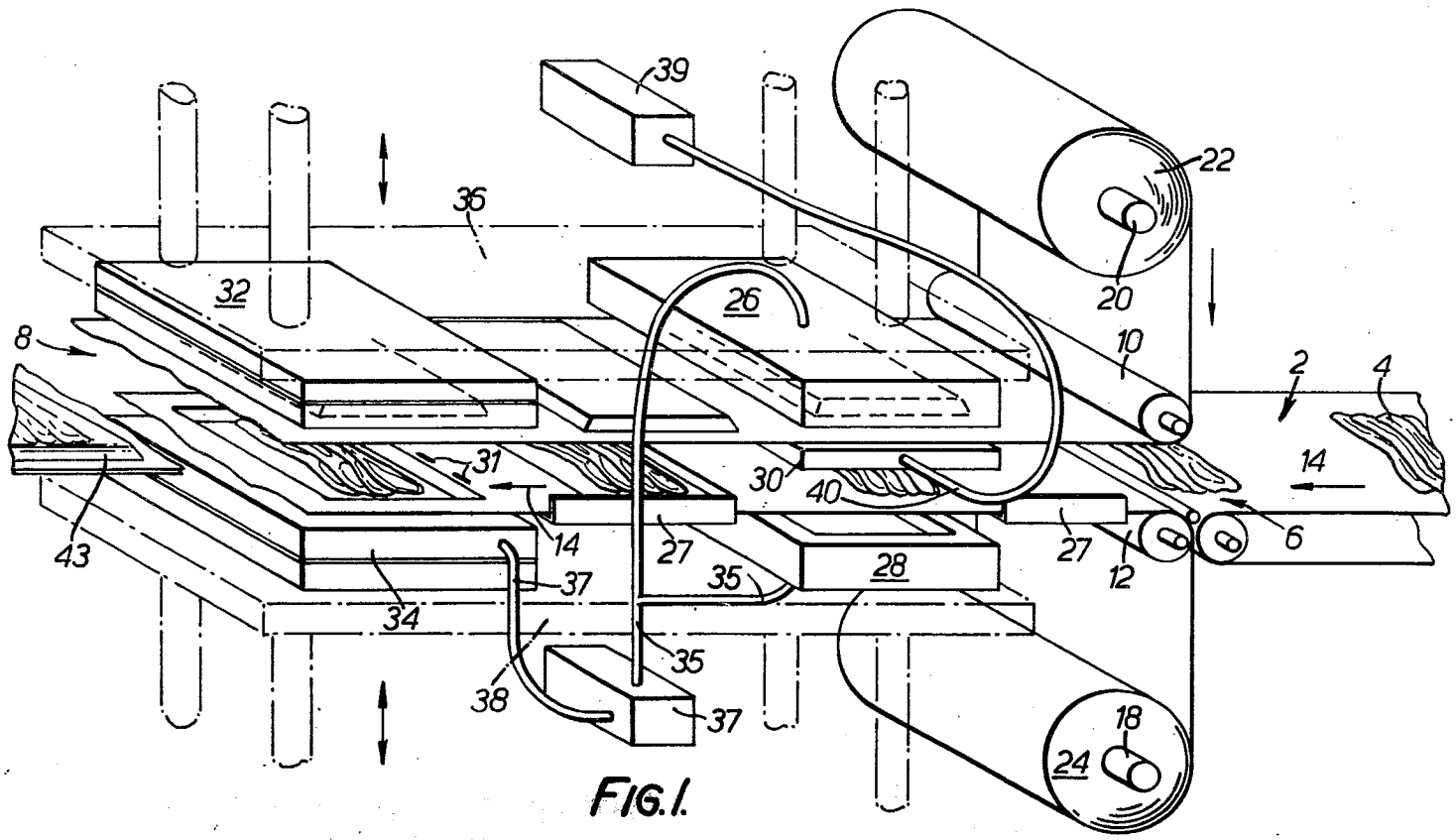
FIG. 1 is a fragmentary perspective view of a first machine.

As shown in FIG. 1 an inlet 6 is defined by two parallel but spaced apart horizontal rollers 10 and 12, and the path 14 followed by the batches 4 as they pass through the machine from the inlet to the outlet is substantially rectilinear and horizontal.

Two spindles 18 and 20 are mounted above and below the path 14 at the inlet. The spindles carry respective rolls 24 and 22 of plastics or cellulose film of a laminate of polythene with polyester, polynylon, or polycellulose for example.

Figure 2:
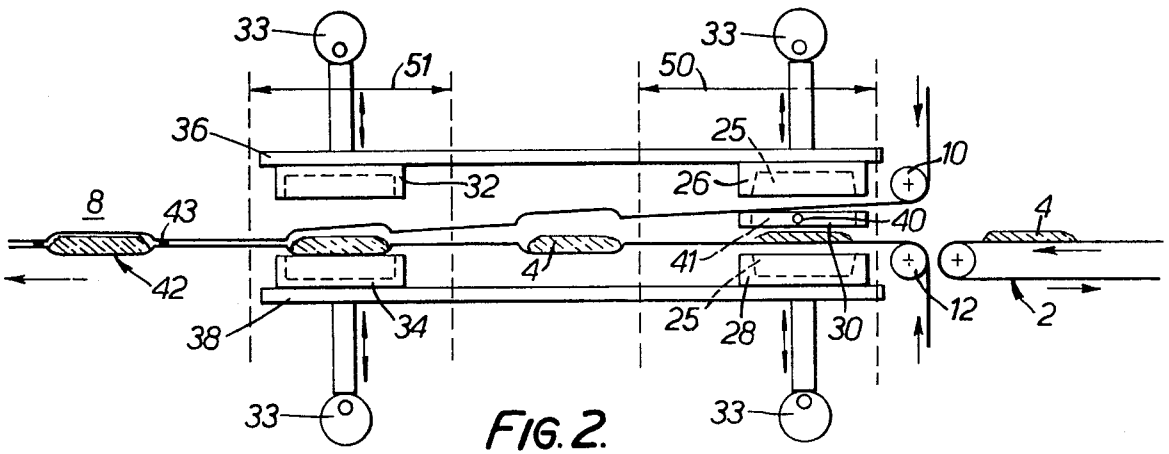
FIG. 2 shows the machine of FIG. 1 in schematic form to assist understanding.

A pair of shaping blocks 26 and 28 lie downstream of the inlet 6 and respectively above and below the path 14 at a web forming station 50 (FIG. 2). Each block has a rectangular recess 25 which has an opening slightly larger than the area of each batch 4. The recesses 25 face one another.

Between the two blocks and spaced from each lies a frame 30 having its opening 41 aligned with and of the same size as the recesses 25. Downstream of the two shaping blocks 26 and 28 are a pair of heat sealing blocks 32 and 34 forming a heat sealing station 51 (FIG. 2). The two blocks 32 and 34 have rectangular heat sealing surfaces arranged to face one another above and below the path 14.

The two blocks 26 and 32 are mounted on a horizontal plate 26 (FIG. 1) located above the path 14, while the two blocks 28 and 34 are mounted on a further horizontal plate 38 beneath the path 14. The plates 36,38 are vertically reciprocable towards and away from one another by cams 33.

The frame 30 has an air conduit 40 extending from one of it walls, the air conduit 40 being connected to a source of compressed air 39.

In operation the leading edge of the rolls of film 22 and 24 are fed around the rollers 10 and 12 and drawn through the machine to form two webs which extend through the machine between the inlet 6 and outlet 8 passing via the web forming and heat sealing stations 50,51. The webs, which are supported at selected points on the machine by guides 27, extend on opposite sides of the frame 30.

The conveyor 2 is driven intermittently, making regular pauses so that the batches 4 are delivered intermittently to the inlet 6. The rollers 10 and 12 and other drive means (not shown) for driving the webs through the machine are driven in synchronism with the conveyor 2 so that the batches 4 suffer no change in motion when transferred from the conveyor on to the lower web at the inlet 6. From the machine inlet 6 to the outlet 8, the lower web acts as a conveyor belt for carrying the batches through the machine.

The blocks 26 and 28 of the web forming station 50 are so located that each time the webs make a pause a batch of bacon rashers will lie between them. Then during the pause the plates 37,38 are actuated by cams 33 to urge the shaping blocks 26,28 together. This causes the webs to be trapped between the blocks 26 and 28 and the frame 30 in substantially airtight manner with the batch 4 lying inside the cavity defined by the webs within the frame 30.

At this point compressed air is fed through the conduit 40 to expand and permanently (i.e. inelastically) stretch the webs into the recesses 25 in the shaping blocks; alternatively or additionally the recesses 25 may be coupled to a vacuum source 37 to achieve the same effect. In this way facing pockets are formed in the two webs; because of the clamping effected as described above, this is achieved with little or no deformation of the perimeter of the web surrounding each pocket. The two plates 36,38 are then moved apart and the webs continue their intermittent motion. The frame 30 is supported by means which enable it to reciprocate between the shaping blocks 26,28 so as not to foul the batch 4 as it passes to and from the shaping blocks.

The heat sealing station 51 is so located that when the webs make a following pause (the next but one pause as shown) the batch 4, which still lies between the pockets previously formed in the two webs, is positioned between the heat sealing blocks 32 and 34. In addition, a second batch 4 has been carried by the lower web to lie between the blocks 26 and 28 of the web forming station 50.

By bringing the plates 36,38 together again pockets are formed in the two webs around this second batch 4 in a manner similar to that described in connection with the first mentioned batch. Simultaneously the two heat sealing blocks 34 and 32 engage the flat perimeters surrounding the pockets of the first batch and heat seal the two pockets peripherally together. The enclosure formed by bringing the two pockets together is evacuated, so that when sealing is completed the batch 4 will be vacuum sealed and packed. To enable or assist the evacuation of the enclosure, one or both of the webs is formed with small holes or slits 31 in the region of heat seal. The slits communicate with apertures in the block 34 which in turn are supplied via a conduit 37a from a vacuum source 37. The sealing operation thereafter closes these punctures to the interior of the enclosure. A sealed pack 42 with its seal 43 is denoted by heavy lines in FIG. 2 is depicted in the drawings at the outlet 8.

After discharge from the outlet 8 the sealed packs are severed (by means not shown) from the upper and lower webs along the outer periphery of their heat seals 43. The cycle is thereafter repeated.

In the described machine the formation of the pockets in the web is achieved without the application of heat, so that no heat is thereby transformed to the bacon rashers, with possibly harmful results. In some circumstances, however, it may be desirable to apply some heat to a web in which pockets are to be formed, in order to facilitate the pocket forming.

A feature which is present in the described machine is that each pocket in the lower web is formed by downwardly stretching a region of web material which supports a batch 4 of bacon slices on its upper surface. A batch 4 beneath which a pocket is being formed in this way will move downwardly under gravity with the web material beneath it, therefore, provided that the indexing of the web is accurate in relation to the web forming station, there is no possibility that grease and the like from the batch will contaminate that annular peripheral area of the web which is to form the heat seal 43 of the eventual pack 42. This, together with the clamping of the web around the batch 4 during the formation of the pocket, ensures that the later heat sealing operation can be fully effective.

It is not essential for the upper web to be of stretchable plastics or cellulosic film as particularly described; moreover methods of bonding other than heat sealing may be used. In application in which no pockets are formed in the top web, the top web may be, for example, of paper or other fibrous material, woven or nonwoven. If of other than plastics or cellulosic material, the upper web may be suitably coated or impregnated to enable it to be heat sealed to the lower web; alternatively it may be adhered to the lower web by gluing or the like.

In the described machines one or both of the webs may carry print. Since for optimum print quality it is desirable for the depth of the pockets to be as small as possible, in applications where both webs carry print and are formed with pockets it is desirable for the depth of the pockets in the two webs to be equal.

In applications in which only the lower web is formed with pockets it is preferred that only the upper web, which undergoes no deformation, is printed.

For accuracy of print registration, in applications where both webs are of plastics or cellulosic sheet material and are printed it is preferred, if possible, to form the webs in common from a single width of film which to that end is slit longitudinally down its center as it is drawn off a reel. Such an arrangement is particularly applicable to the machine described in conjunction with FIGS. 1 and 2.

The packing machine described is particularly advantageous in that the web is not provided with preformed pockets and there is no need to make special provision to accurately locate articles in the pockets as the articles are transferred from the conveyor 2.

The conveyor 2 for locating batches onto the web can advantageously take the form of that described in our copending British Patent Application 42712/74 which is the priority document for U.S. Pat. Application Ser. No. 618,335 for Conveyor Handling Systems, filed Oct. 1, 1975.

Many modifications can be made without departing from the spirit and scope of the invention as defined by the appended claims.

I claim:

1. A method of producing packs, comprising the steps of supporting a sheet of inelastically stretchable packing material generally horizontally, locating the intended contents of the packs in succession on the sheet, clamping the sheet peripherally of each region of the sheet material which supports the intended contents, applying differential pressure to each region to inelastically stretch the sheet in the downward direction to form an upwardly open pocket holding the said contents, superimposing a further sheet of material upon the first-mentioned sheet material to close the pocket, and bonding the further sheet to the first mentioned sheet of material peripherally of the said region to form a said pack.

2. A method according to claim 1, including the step of inelastically deforming said further sheet of material to form pockets in concave opposition to the pockets in the first sheet material.

3. A method according to claim 1, wherein the two sheets are of identical composition and identically formed with the said pockets.

4. A packaging machine for forming packs, comprising first guide means arranged for guiding a first web of a plastics or cellulosic material along a generally horizontal path from an inlet to an outlet, means for feeding the intended contents of said packs to said inlet onto successive regions of the upper surface of the web for transport along said path in longitudinally spaced relation, web clamping means mounted to clamp the web peripherally of the regions, web forming means mounted in relation to the web clamping means to stretch the clamped web inelastically in the downward direction by differential pressure with the intended contents thereon and thereby form upwardly open pockets having the intended contents received therein, second guide means to guide a second web of material over the first web, after the said stretching thereof, and sealing means effective upon the superimposed webs to seal the webs together peripherally of, and to close, the pockets.

5. A machine according to claim 4, including second web forming means for forming in the second web pockets which, when the webs are superimposed, are in register with the pockets of the first web and in concave opposition thereto.

6. A machine according to claim 5, wherein first and second web forming means are adapted to stretch respective first and second webs by similar amounts so that the pockets in the two webs are identical.

7. A machine according to claim 4 wherein the sealing means comprises a heat sealing device.

8. A packing machine comprising means for guiding a first web of flexible packing material along a horizontal path, means for feeding a succession of articles onto the first web to be conveyed by the first web along the horizontal path, means for forming a cavity at least partially around each article and through which the first web passes, pressure difference means for inelastically expanding the first web to conform to the cavity in which the article is at least partially housed and so form a pocket therein, means for guiding a second web to cover the pockets in the first web, and means for sealing the perimeter of the first web around the said pocket to the adjacent portion of the second web.

9. A machine according to claim 8 wherein the sealing means is heat-sealing means.

10. A machine according to claim 8, wherein the cavity forming means comprises means totally surrounding each article, and including guide means guiding the second web through the cavity forming means along with the first web but lying on the opposite side of the article to the first web, and in which the pressure difference means comprises means to inelastically expand both the webs respectively to conform to adjacent portions of the cavity.

11. A machine according to claim 10, wherein said cavity forming means includes a pair of shaping blocks having facing recesses, and a frame defining an aperture corresponding to the recesses and located between the two shaping blocks, the web guide means comprises means guiding the said two webs between the shaping blocks but on opposite sides of the frame, and the cavity forming means also includes means for moving the two blocks towards the frame to clamp the webs against the frame.

12. A machine according to claim 11, wherein the pressure difference means comprises means for supplying compressed air through the wall of the frame to the said cavity.

13. A machine according to claim 8, wherein the sealing means comprises a pair of heat sealing blocks located downstream of the cavity forming means, and means for moving the two blocks together to grip the two webs between them and heat seal the two webs together.

* * * * *